US006418087B1

(12) United States Patent
Huang

(10) Patent No.: US 6,418,087 B1
(45) Date of Patent: Jul. 9, 2002

(54) FIBER OPTICS POLYCHROMATIC ANIMATION CONFIGURATION FOR CLOCK

(76) Inventor: Ching Ju Huang, No. 16, Alley 242, Hsin Hsing Rd., Chu Pei, Hsin Chu Hsien (TW)

( * ) Notice: Subject to any disclaimer, the term of this patent is extended or adjusted under 35 U.S.C. 154(b) by 31 days.

(21) Appl. No.: 09/633,877

(22) Filed: Aug. 7, 2000

(51) Int. Cl.[7] ..... G04B 19/04

(52) U.S. Cl. ..... 368/228

(58) Field of Search ..... 368/82–84, 223, 368/76, 228, 239–242

(56) References Cited

U.S. PATENT DOCUMENTS 5,526,327 A * 6/1996 Cordova ..... 368/82

* cited by examiner

*Primary Examiner*—Bernard Roskoski
(74) *Attorney, Agent, or Firm*—Bacon & Thomas

(57) ABSTRACT

A fiber optics polychromatic animation configuration for a clock includes an array of penetrating holes in an appropriate amount installed on the numbers and surface of the dial in order to provide polychromatic patterns when the holes are penetrated by fiber optics coupled to multicolor LEDs driven by a circuit board. The circuit board drives the LEDs so as to illuminate the fiber optics accordingly, particularly to display polychromatic animation while the clock is alarming by a time signal or a timer setting, or even while the clock darkens up during the nighttime so that it is still capable of showing time and patterns distinctly.

3 Claims, 3 Drawing Sheets

FIBER OPTICS POLYCHROMATIC ANIMATION CONFIGURATION FOR CLOCK

FIELD OF THE INVENTION

The present invention relates to the field of a fiber optics polychromatic animation configuration for a clock, and more particularly to a kind of configuration wherein the fiber optics inserted into the dial of a clock will be illuminated properly by means of LEDs so as to show a consequent polychromatic animation effect on the dial of that clock.

BACKGROUND OF THE INVENTION

With reference to the conventional clock or alarm clock, although some have more attractive patterns on their dials, many clocks add illuminable materials onto the numbers of the clock in case one needs to read the time properly in a dark place or during the nighttime. As a result, no matter what changes are made on the styles of the clock or whichever improvement and creation is made on the patterns of the dials, it is still impossible to get rid of the traditional feeling of a stiff appearance. Because the clock is such an indispensable article, the clock gradually becomes just another dull, insipid and daily necessity irrespective of attempts to make it more attractive.

Therefore, the major objective of the present invention is to provide a kind of fiber optics polychromatic animation configuration for a clock having an array of penetrating holes in an appropriate amount installed on the numbers and surface of the dial in order to configure all kinds of polychromatic patterns when the holes have been penetrated by fiber optics, the fiber optics being optically coupled to multicolor LEDs inserted into the circuit board so that the circuit board will then light up the said LEDs accordingly and provide the effect of polychromatic animation upon activation of an alarm, i.e., while the clock is alarming, in response to a time signal or a timer setting, and thus enhance the practical value of the configuration accordingly.

It is another objective of the present invention to install a voice circuit into the circuit board so that it will be capable of matching the animation of fiber optics and generating an enhanced effect of voice or music while the clock is alarming by a time signal or by time alarm setting.

An embodiment of the present invention will now be described by way of example with reference to the accompanying drawings as follows:

DETAILED DESCRIPTION

Figure 1:
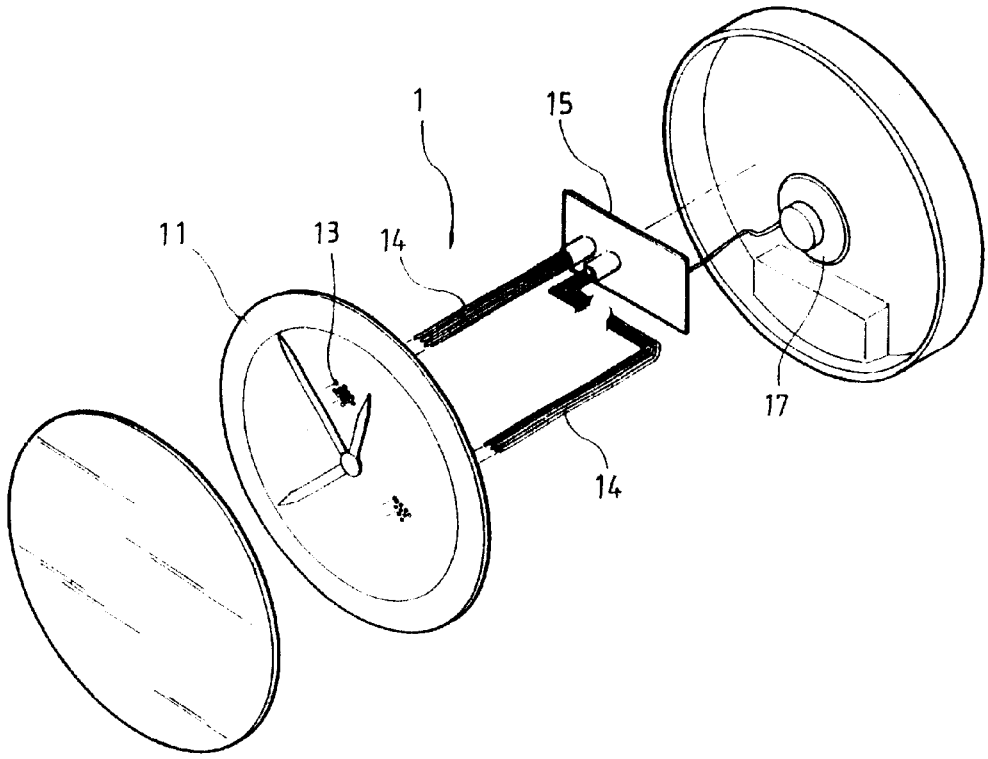
FIG. 1 is a perspective exploded view of the present invention.
Figure 2:
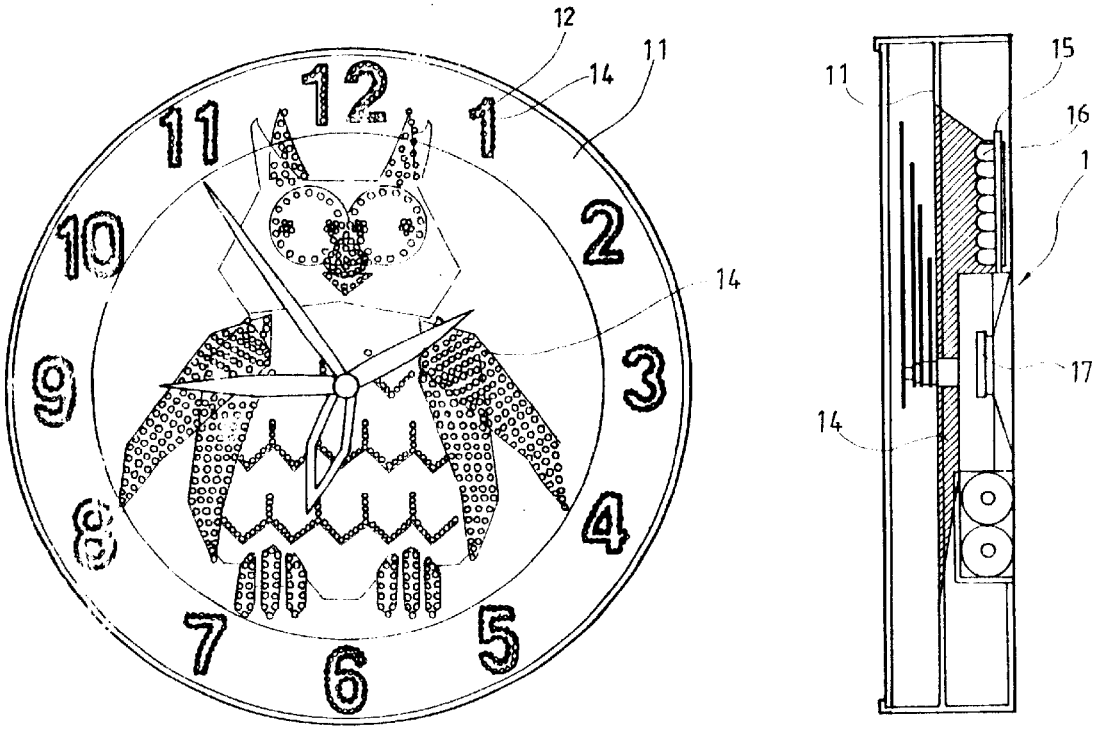
FIG. 2 is a schematic and partial sectional view of the dial of clock according to the present invention.
Figure 3:
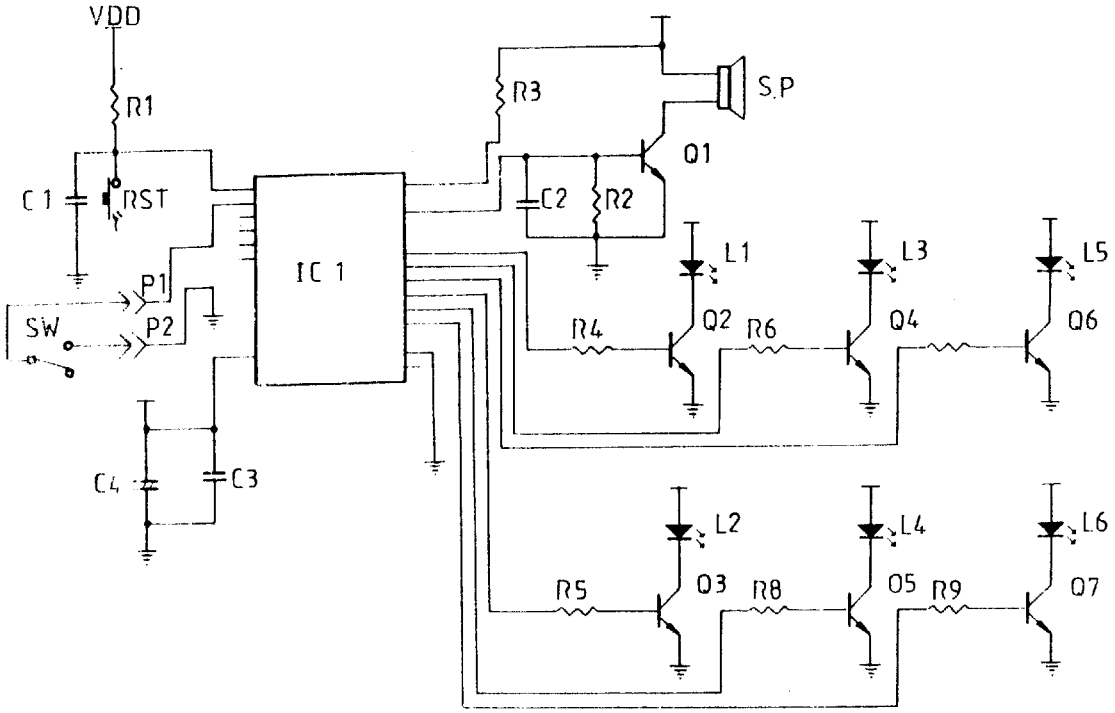
FIG. 3 is a circuit diagram of a preferred embodiment according to the present invention.

With reference to FIGS. 1–3, the main configuration according to the present invention consists of an array of penetrating holes 13 having a same diameter installed onto the numbers 12 and surface of the dial 11 of the clock 1 in order that optical fibers 14 with a diameter a little bit smaller than the said penetrating holes 13 will penetrate through the penetrating holes from the back of the dial 11. The portion of the fiber optics 14, which has been penetrated through the said penetrating holes 12, will then be heated properly so as to fix the fiber optics 14 in the penetrating holes 12 and thereby configure all kinds of patterns. In addition, the special procedure of heating and enlarging the front portion of the fiber optics 14 will result in an additional effect of simultaneously spreading out and softening the light source and thus permitting the dial to show animation all the time.

The whole beam of the fiber optics 14 is provided by LEDs 16 optically coupled to the optical fibers and set up on a piece of circuit board 15 with predetermined positions and numbers of the LEDs. The circuit board 15 is connected to the switch of the clock 1, and in this way at the time when the clock 1 is alarming by a time signal or timer setting, it will start the circuit board 15 and light up the LEDs 16. By means of an appropriate control method, different beams of fiber optics 15 are illuminated with each LED 16 in such way that the dial 11 will then generate an effect of different patterns of polychromatic animation, and also will light up the numbers 12 inserted in the dial 11.

Additionally, a voice or musical circuit may be installed onto the circuit board 15 so that while the clock is alarming by a time signal or time alarming setting, the circuit board 15 will drive the speaker 17 to start speaking or playing music accordingly and thus it will definitely enhance the value of the configuration.

FIG. 3 is a circuit diagram of the preferred embodiment according to the present invention wherein, as shown in the illustration, the main configuration according to the present invention consists of a single integrated circuit ICI which has been written in and programmed with a controlling procedure for voice or music. The switch SW is switched-on while the clock is alarming by a time signal or time alarm setting so as to start the ICI and thus drive transistors Q2 to Q7 respectively, and in this way the different beams of fiber optics will be controlled and lighted up alternatively in a preset pattern in order to provide an effect of polychromatic animation. Meanwhile, the ICI will transmit the signals of voice or music and generate sound effects while the speaker is being driven under the assistance of the transistor Q1.

In view of the present invention, wherein there is an array of fiber optics installed onto the dial of the clock in order to show animation while the fiber optics are being illuminated by LEDs, the dial of clock will generate an effect of polychromatic animation when the clock is alarming by a time signal or a timer setting accordingly.

Although preferred embodiments have been disclosed in detail, all variations and modifications of the invention hereby are also intended to be covered by the spirit of the invention and the scope of the claims.

I claim:

1. An arrangement for illuminating a dial and numbers of a clock, said dial and said numbers each having a plurality of penetrating holes formed therein, comprising:

a plurality of optical fibers installed in said penetrating holes in said dial and said penetrating holes in said numbers;

a plurality of LEDs having different colors, said LEDs being optically coupled to said optical fibers and installed on a circuit board, said circuit board including circuitry for driving said LEDs to cause said plurality of optical fibers to display a polychromatic animation pattern.

2. An arrangement as claimed in claim 1, wherein said clock is an alarm clock, and wherein said circuitry causes said polychromatic animation pattern to be displayed upon activation of an alarm in response to a time signal or timer setting.

3. An arrangement as claimed in claim 1, wherein said fibers are fixed in said penetrating holes by heating the fibers until the fibers expand to fit tightly in said holes, thereby not only fixing said fibers in said holes but also causing spreading and softening of light carried by the fibers.

* * * * *